US007789131B2

(12) United States Patent
Gaudette

(10) Patent No.: US 7,789,131 B2
(45) Date of Patent: Sep. 7, 2010

(54) HYDRAULIC PUMP SYSTEM FOR DELIQUIFYING LOW RATE GAS WELLS

(75) Inventor: Sean L. Gaudette, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 160 days.

(21) Appl. No.: 12/203,565

(22) Filed: Sep. 3, 2008

(65) Prior Publication Data

US 2010/0051282 A1 Mar. 4, 2010

(51) Int. Cl.
*E21B 43/00* (2006.01)

(52) U.S. Cl. ..... 166/72; 166/68; 166/105; 166/369; 166/370; 417/404

(58) Field of Classification Search ..... 166/68, 166/72, 105, 369, 370; 417/401, 404
See application file for complete search history.

(56) References Cited

U.S. PATENT DOCUMENTS 4,403,919 A * 9/1983 Stanton et al. ..... 417/53
4,871,302 A * 10/1989 Clardy et al. ..... 417/404
2008/0149325 A1* 6/2008 Crawford ..... 166/68

* cited by examiner

*Primary Examiner*—Giovanna C Wright
(74) *Attorney, Agent, or Firm*—Shawn Hunter

(57) ABSTRACT

Water is removed from a natural gas well using a piston pump is driven by a power fluid that is pumped into the wellbore. The power fluid is intermixed within wellbore water and pumped out of the wellbore along with the removed water.

19 Claims, 3 Drawing Sheets

HYDRAULIC PUMP SYSTEM FOR DELIQUIFYING LOW RATE GAS WELLS

BACKGROUND OF THE INVENTION

1. Field of the Invention

The invention relates generally to devices and methods for removing water from a subterranean wellbore.

2. Description of the Related Art

The presence of water is natural gas wells is a significant hindrance to the production of natural gas. Water naturally migrates into a wellbore along with natural gas from the surrounding formation. In the beginning of production, the gas flow rate is high enough that it carries the water to surface. As the well matures, the flow rate begins to drop. Eventually, water collects in the wellbore to the point where the production rate becomes very low. In some cases, the weight of the water increases pressure within the wellbore and prevents gas in the surrounding formation from entering the wellbore.

Prior art approaches to the removal of water from a natural gas well are discussed in U.S. Pat. Nos. 5,211,242; 5,501,279 and 6,629,566.

SUMMARY OF THE INVENTION

The invention provides devices and systems that are useful for removing water from a gas well. In accordance with systems and methods of the present invention, water is removed from a natural gas well using a piston pump is driven by a power fluid that is pumped into the wellbore. An exemplary hydraulic downhole pump is described that is double-acting and double-ended. However, other pump designs may be used, depending upon the depth of the wellbore and the desired output.

In preferred embodiments, a pilot valve is used to actuate the pump. In the instance where a double-acting downhole pump is used, the cycling valve alternately directs a flow of power fluid into opposing hydraulic chambers in the downhole pump to actuate the downhole pump.

In preferred embodiments, brine is used as the power fluid for the pump. A surface unit pumps filtered brine down a conduit to the downhole pump. The brine mixes with the produced water and is returned to the surface along with the produced water.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
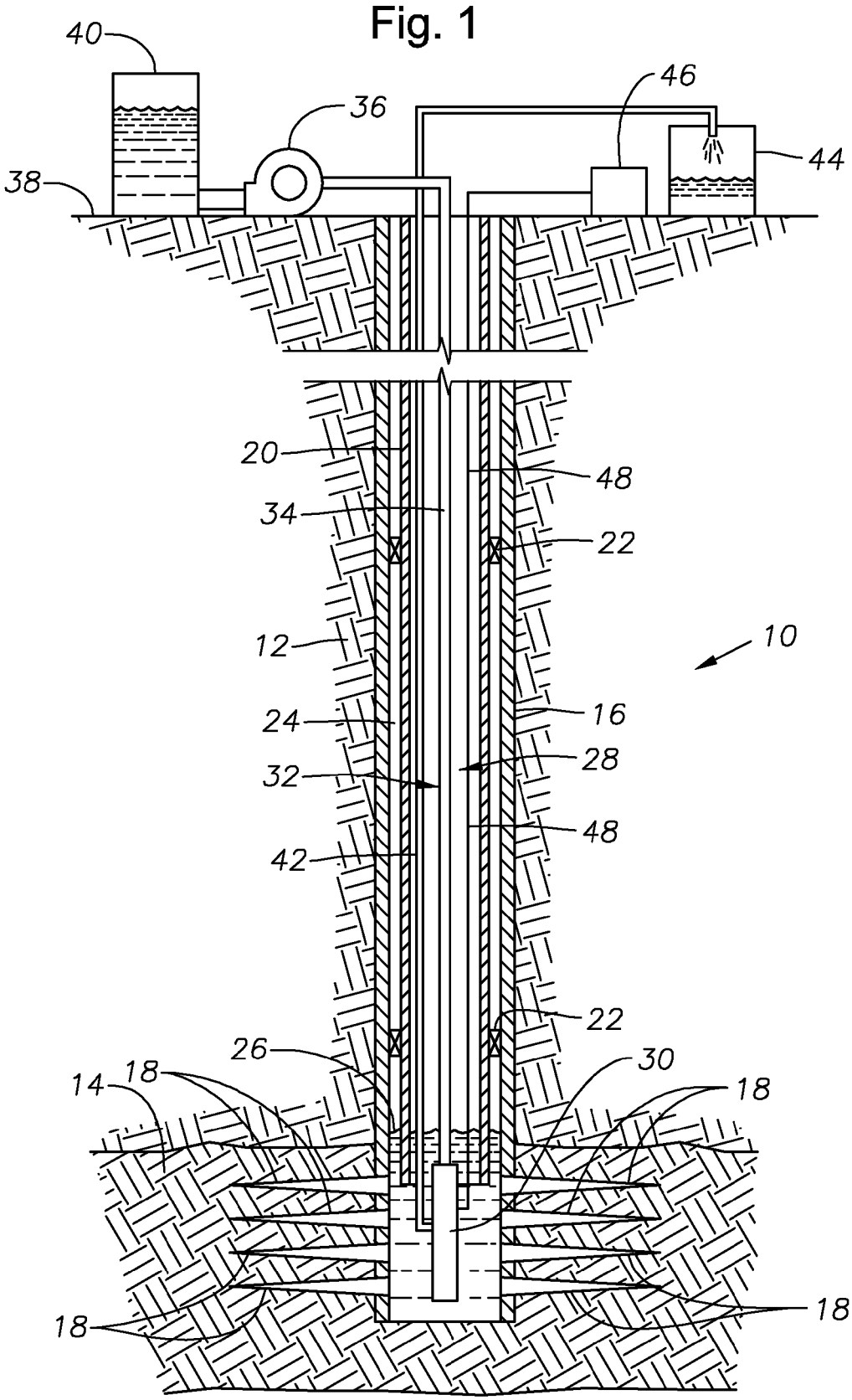
FIG. 1 is a side, cross-sectional view of an exemplary natural gas wellbore with a dewatering pump apparatus in accordance with the present invention.

FIG. 1 depicts an exemplary natural gas production wellbore 10 that has been drilled through the earth 12 down to a natural gas-bearing formation 14. The wellbore 10 has been lined with casing 16. Perforations 18 extend through the casing 16 and into the formation 14. A production tubing string 20 extends downwardly into the wellbore 10 and is set into place by one or more packers 22. An annulus 24 is defined between the production tubing string 20 and the casing 16. A collection of water 26 is located at the lower end of the wellbore 10.

A dewatering apparatus, generally designated at 28 is disposed within the wellbore 10 through the production tubing string 20. The dewatering device 28 generally includes a downhole hydraulic pump device 30 which has been disposed into the production tubing string 20 by a running string 32. The running string 32 may be a wireline running string or a string of coiled tubing, as are known in the art. An inflow fluid conduit 34 is incorporated into or disposed along side of the running string 32 and extends from a fluid pump 36, which is preferably located at the surface 38, down to the pump device 30. The pump 36 is operably interconnected with a supply of power fluid 40. The power fluid 40 is an operating fluid for the downhole pump device 30 and is preferably filtered brine (salt water). A fluid return line 42 extends from the downhole pump 30 to the surface 38 wherein it is preferably associated with a fluid collection point 44, such as a sump. In some preferred embodiment, a controller 46 is operably associated with the downhole pump 30 via a control line 48. The controller 46 may be a preprogrammed programmable computer controller, of a type known in the art for actuating the pilot valve 54 of the downhole pump 30 in accordance with a predetermined scheme. In a currently preferred embodiment, the controller 46 operates the pilot valve 54 on a timer. During operation, the fluid pump 36 preferably flows power fluid down through the inflow fluid conduit 34 in a continuous manner.

Figure 2:
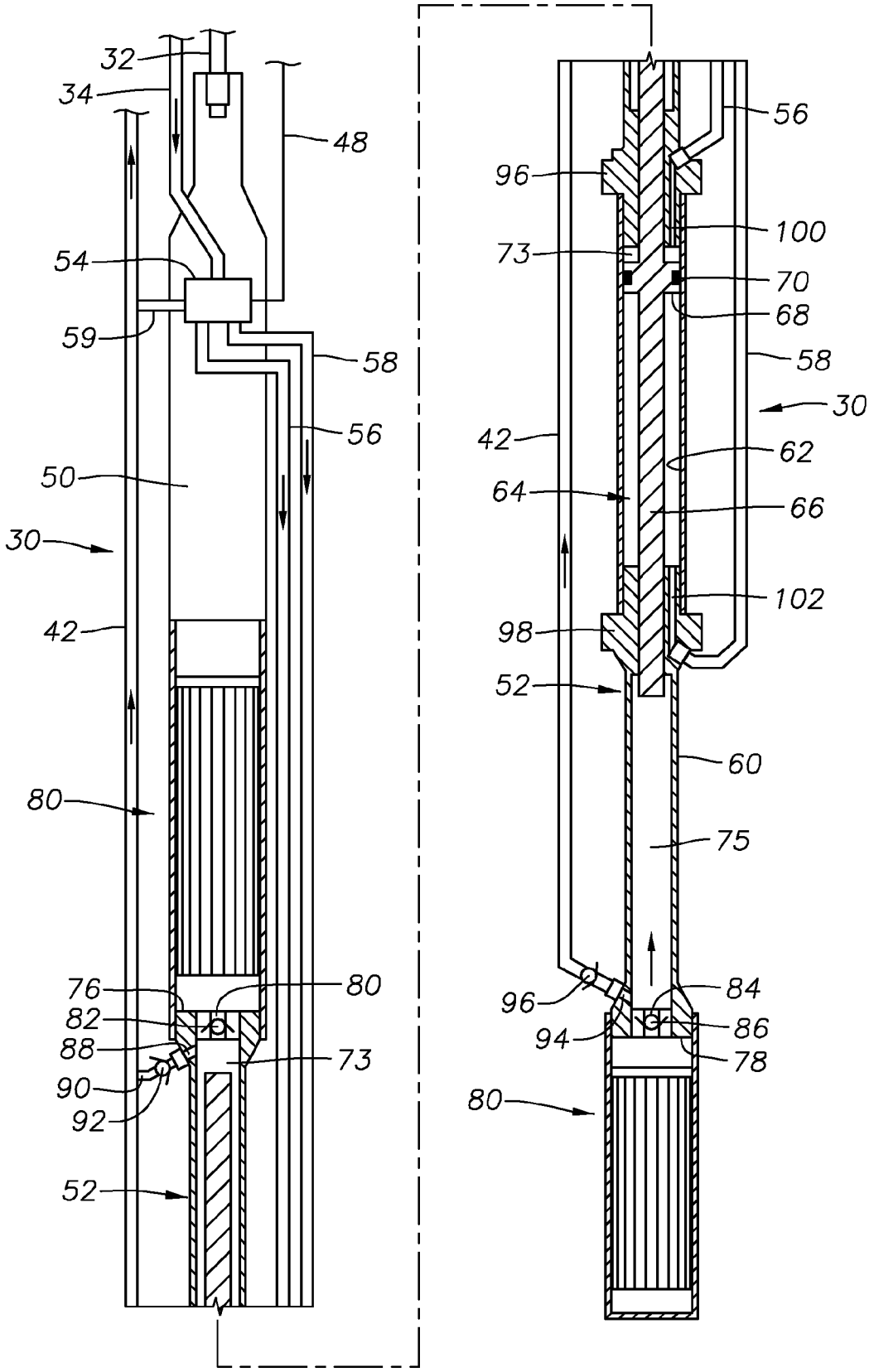
FIG. 2 is an enlarged, side cross-sectional view of downhole portions of the exemplary pump apparatus shown in FIG. 1.

FIG. 2 illustrates an exemplary downhole pump 30 in greater detail. The pump device 30 includes a pilot control section 50 and a piston pump portion 52. It can be seen that the inflow fluid conduit 34 runs into a pilot valve 54 within the control section 50. A pilot valve is a known device which can be used to control the flow of fluid through the inflow conduit 34 and direct it into either of two chamber conduits 56, 58. An example of a suitable pilot valve for this application is an air-operated directional, four-way, direct acting, spool (4/2) control valve. Pilot valves of this type are available commercially from a number of manufacturers. One such valve suitable for use as the pilot valve 54 is the AODV-12-4A valve available from Command Controls Corporation of Elgin, Ill. In the depicted embodiment, the pilot valve 54 is operably interconnected via control line 48 to the controller 46. A fluid exhaust line 59 extends from the pilot valve 54 to the fluid return line 42.

The pump portion 52 includes an elongated, generally cylindrical housing 60 which defines an interior piston chamber 62. A piston member 64 is disposed within the piston chamber 62 and is axially moveable therewithin. The piston member 64 includes a central shaft portion 66 with a radially outwardly extending flange 68. The flange 68 forms a fluid seal against the housing 60 with the preferred assistance of an annular seal ring 70. The flange 68 divides the piston chamber 62 into upper and lower power chambers 72, 74, respectively. In FIG. 2, the piston member 64 is shown in an axially upward position with respect to the housing 60, and as a result, the volume within the upper chamber 72 is minimized, while the volume of the lower chamber 74 has been maximized.

The housing 60 of the pump portion 52 as two axial ends 76 and 78. A tubular sand screen 80, of a type known in the art for filtering sand and other debris from fluid, is preferably secured to each axial end 76, 78. A first fluid inlet 80 is formed within the upper axial end 76 of the housing 60 to permit fluid communication between the sand screen 80 and the upper power chamber 73. A one-way check valve 82 is located within the fluid inlet 80 so that fluid may pass into the upper power chamber 73 through the fluid inlet 80, but cannot exit the upper power chamber 73 via the fluid inlet 80.

A second fluid inlet 84 is formed into the lower axial end 78 of the housing 60 to permit fluid communication between the lower sand screen 80 and the lower power chamber 75. One-way check valve 86 is located within the second fluid inlet 84 to ensure that fluid may pass into the lower power chamber 75 through the fluid inlet 84, but not exit the lower chamber 75 through the inlet 84.

A first fluid outlet 88 is also disposed within or near the upper axial end 76 of the housing 60. A fluid conduit 90 extends between the fluid outlet 88 and the fluid return line 42. A one-way check valve 92 is associated with the first fluid outlet 88 so that fluid may exit the upper power chamber 73 via the fluid outlet 88 but not enter the upper power chamber 73 via the fluid outlet 88.

A second fluid outlet 94 is formed within or near the lower axial end 78 of the housing 60. The second fluid outlet 94 is associated with the fluid return line 42 so that fluid may be communicated from the lower fluid chamber 74 and the fluid return line 42. A one-way check valve 96 is associated with the second fluid outlet 94 so that fluid may exit the lower power chamber 75 via the fluid outlet 94 but not enter the lower power chamber 75 via the fluid outlet 94.

In a preferred embodiment, the upper and lower power chambers 73, 75 each contain collars 96, 98, respectively. The collars 96, 98 function to guide the shaft 66 of the piston member 64 and provide a fluid seal against the shaft 66 preventing power fluid from flowing into chambers 73 or 75. In addition, the collars 96, 98 each include a power fluid inlet 100, 102, respectively, which are formed into the collar 96 or 98. The first chamber conduit 56 is interconnected via a fluid inlet 96 with the upper power chamber 73, while the second chamber conduit 58 is interconnected via fluid inlet 102 with the lower power chamber 75.

The pump portion 52 is a dual-acting and dual-ended pump. The pump portion 52 is dual-acting in that the pump portion 52 pumps fluid as the piston member 64 is moved axially both in the upward direction and in the downward direction, relative to the housing 60. The pump portion 52 is dual-ended in that a pumping mechanism is provided at both axial ends 76, 78 of the pump portion 52.

Figure 3:
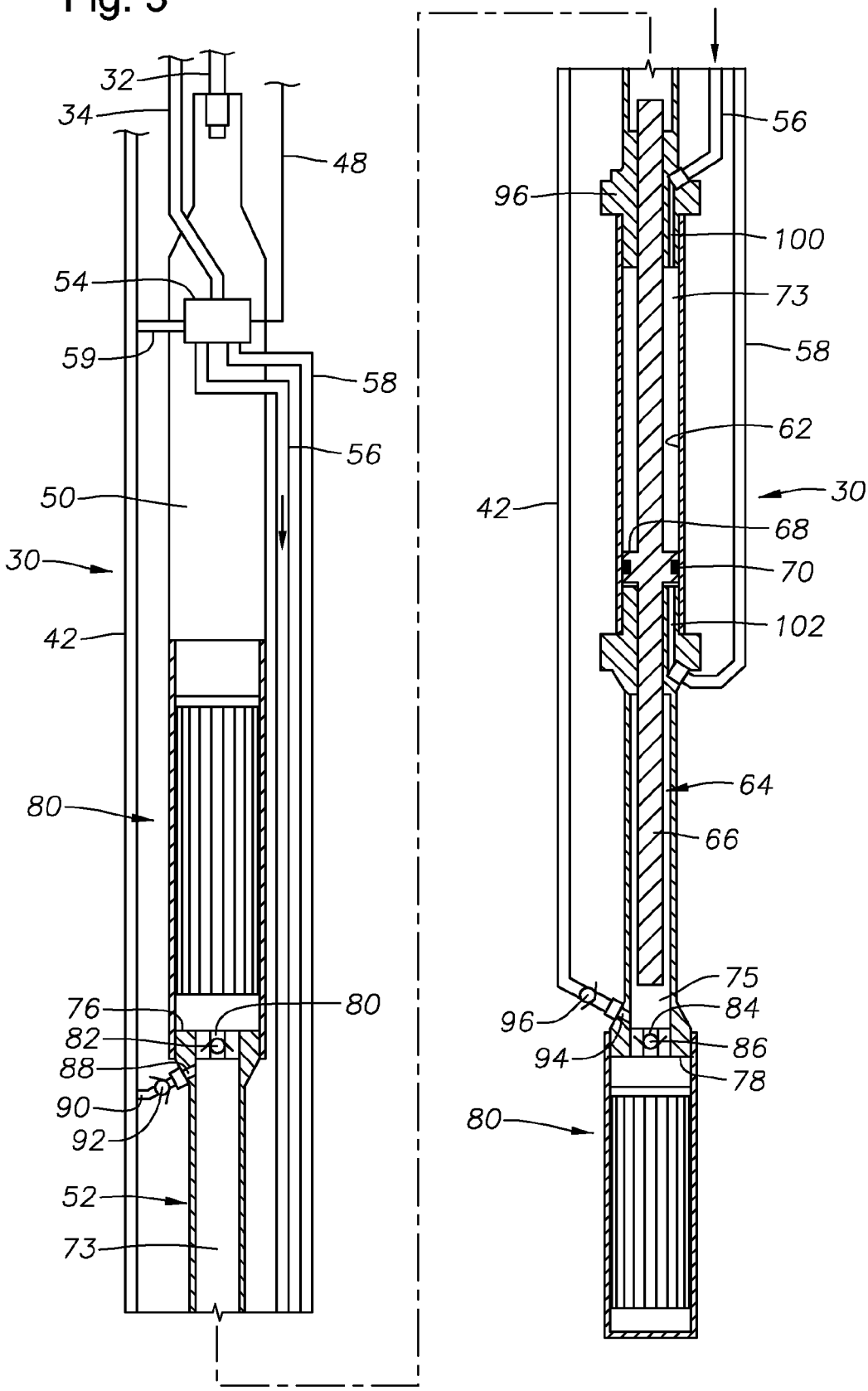
FIG. 3 is a side cross-sectional view of the pump portions shown in FIG. 2, now with the piston member having been shifted to a second position.

FIG. 3 depicts the pump 30 now moved from the position shown in FIG. 2 to a second, stroked position. The pilot valve 54 has flowed fluid through the chamber conduit 56 and into the upper power chamber 73. Increased fluid pressure bears upon the flange 68 of the piston member 64 to urge it downwardly within the piston chamber 62. As the piston member 64 moves downwardly, the volume of the upper power chamber 73 is increased while the volume of the lower power chamber 75 is decreased. As power fluid is flowed into the upper power chamber 73 through chamber conduit 56, power fluid exits the lower power chamber 75 via the chamber conduit 58. Power fluid exiting the lower chamber 75 via conduit 58 will be returned to the pilot valve 54 and directed by the pilot valve 54 to the fluid return line 42 via exhaust line 59. Wellbore water within the lower power chamber 75 is pumped toward the surface 38 through the fluid outlet 94, check valve 96 and fluid return line 42. As the wellbore water enters the fluid return line 42 it is mixed with the power fluid from the lower power chamber 75. At the same time, downward movement of the piston member 64 within the piston chamber 62 draws wellbore water into the upper power chamber 73 through the fluid inlet 82.

The pump 30 is then operated to move from the position shown in FIG. 3, back to the position shown in FIG. 2. The pilot valve 54 switches the flow of power fluid from the chamber conduit 56 to the chamber conduit 58. This causes power fluid to enter the lower power chamber 75 through power fluid inlet 102. Fluid pressure bears upon the flange 68 of the piston member 64 and urges the piston member 64 axially upwardly within the piston chamber 62. As the piston member 64 moves upwardly, the shaft 66 displaces wellbore water 26 and power fluid from within the upper power chamber 73. The displaced wellbore water is flowed through the fluid outlet 82 past check valve 92 and into the fluid return line 42 for return to the fluid collection point 44. Power fluid within the upper power chamber 73 exits the upper chamber 73 via the chamber conduit 56 to the pilot valve 54 where it is directed via exhaust line 59 to the fluid return line 42. Once within the return line 42, the power fluid is mixed with wellbore water. Also, upward movement of the piston member 64 draws wellbore water 26 into the lower power chamber 75 via the fluid inlet 86.

As the pilot valve 54 continues to switch fluid flow between the two chamber is conduits 56, 58, the piston member 64 will be alternately moved axially upwardly and downwardly with respect to the housing 60 of the pump portion 52 in a reciprocating manner. Each axial movement of the piston member 64, or stroke, of the piston member 64, will result in an amount of wellbore water 26 being flowed upwardly through the fluid return line 42 to the collection point 44. It is pointed out that, in FIG. 1, the supply of operating fluid 40 is shown as separate from the fluid collection point 44. However, those of skill in the art will understand that the fluid supply 40 and the collection point 44 may be combined.

As noted, the controller 46 may operate the pilot valve 54 in accordance with a predetermined scheme, and, in a preferred embodiment, the pilot valve 54 is operated according to a time scheme from the controller 46. In that case, the pilot valve 54 switches fluid flow between the two chamber conduits 56, 58 for a particular amount of time that is sufficient to substantially completely shift the piston member 64 within the piston chamber 62. In an alternative embodiment, the predetermined controller 46 scheme is based upon a substantially complete stroke of the piston member 64 within the piston chamber 62. A substantially complete stroke would be when the piston member 64 has reached either its furthest upward position or furthest downward axial position with respect to the housing 60. When the piston member 64 has achieved a substantially complete stroke, the pilot valve 54 will detect a pressure spike within either chamber line 56 or 58. When the pressure spike is detected, the controller 46 will command the pilot valve 54 to switch the fluid flow between the chamber conduits 56, 58 in order to move the piston member 64 in the opposite axial direction with respect to the housing 60.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A dewatering system for removing water from a hydrocarbon wellbore, the system comprising:

a pump device that is disposed within the wellbore, the pump device operable to draw in wellbore water and pump the wellbore water from the wellbore a fluid return line operably associated with the pump device for transmitting fluid from the wellbore;

a power fluid powering the pump device to draw in wellbore water and pump the wellbore water from the wellbore, the power fluid being exhausted from the pump device to the fluid return line; and the wellbore water being pumped into the fluid return line separately from the power fluid, the wellbore water and the power fluid being mixed within the return line.

2. The dewatering system of claim 1 wherein the power fluid comprises brine.

3. The dewatering system of claim 1 wherein the power fluid is flowed into the pump device under impetus of a fluid pump.

4. The dewatering system of claim 1 wherein the pump device further comprises:

a pump housing defining a piston chamber within; and a piston member moveably located within the piston chamber, movement of the piston member within the piston chamber causing wellbore water to be drawn into the piston chamber.

5. The dewatering system of claim 4 wherein the pump device further comprises a pilot valve operably associated with the power fluid for controlling axial movement of the piston member within the piston chamber in a reciprocating manner.

6. The dewatering system of claim 5 wherein the pilot valve controls movement of the piston member within the piston chamber by controlling the flow of power fluid into the piston chamber.

7. The dewatering system of claim 6 wherein the pilot valve is actuated in accordance with a predetermined scheme.

8. The dewatering system of claim 7 wherein the predetermined scheme is a time schedule.

9. The dewatering system of claim 7 wherein the predetermined scheme comprises:

detecting when the piston member has completed a substantially complete stroke within the piston chamber; and moving the piston member in an opposite axial direction.

10. The dewatering system of claim 4 wherein a one-way check valve is operably associated with the fluid inlet so that wellbore water can enter the piston chamber through the fluid inlet but not exit the piston chamber through the fluid inlet.

11. The dewatering system of claim 4 wherein a one-way check valve is operably associated with a fluid outlet so that wellbore water can exit the piston chamber through the fluid outlet but not enter the piston chamber through the fluid outlet.

12. The dewatering system of claim 4 wherein the pump device is double ended.

13. The dewatering system of claim 4 wherein the pump device is double-acting.

14. A dewatering system for removing water from a hydrocarbon wellbore, the system comprising:

a pump device that is disposed within the wellbore, the pump device operable to draw in wellbore water and pump the wellbore water from the wellbore;

a fluid return line operably associated with the pump device for transmitting fluid from the wellbore;

a power fluid powering the pump device to draw in wellbore water and pump the wellbore water from the wellbore, the power fluid being exhausted from the pump device to the fluid return line;

the wellbore water being pumped into the fluid return line separately from the power fluid, the wellbore water and the power fluid being mixed within the return line; and a surface-based fluid pump to flow the power fluid to the pump device.

15. The dewatering system of claim 14 wherein the pump device further comprises:

a pump housing defining a piston chamber within; and a piston member moveably located within the piston chamber, movement of the piston member within the piston chamber causing wellbore water to be drawn into the piston chamber.

16. The dewatering system of claim 15 wherein the pump device further comprises a pilot valve operably associated with the power fluid for controlling axial movement of the piston member within the piston chamber in a reciprocating manner.

17. The dewatering system of claim 16 wherein the pilot valve controls movement of the piston member within the piston chamber by controlling the flow of power fluid into the piston chamber.

18. A method for removing a wellbore fluid from a wellbore comprising the steps of:

disposing a pump device within a wellbore containing an amount of wellbore fluid that it is desired to remove;

flowing a power fluid to the pump device to cause the pump device to draw wellbore fluid into the pump device;

flowing wellbore fluid from the pump to a fluid return line;

flowing exhausted power fluid from the pump to the fluid return line separately from the wellbore fluid; and flowing the mixed power fluid and wellbore fluid through the fluid return line and from the wellbore.

19. The method of claim 18 wherein the step of flowing a power fluid to the pump device further comprises operating a surface-based fluid pump to flow the fluid through a power fluid supply conduit.

* * * * *